US009458693B1

(12) United States Patent
Matthews-Ewald et al.

(10) Patent No.: US 9,458,693 B1
(45) Date of Patent: Oct. 4, 2016

(54) BOREHOLE ABANDONMENT METHOD USING RETRIEVABLE INFLATABLE BRIDGE PLUG WITH SEPARATE SEAL AND ANCHOR COMPONENTS

(71) Applicant: BAKER HUGHES INCORPORATED, Houston, TX (US)

(72) Inventors: Christopher R. Matthews-Ewald, Houston, TX (US); Halit Dilber, Katy, TX (US); John M. Sprott, Spring, TX (US); Babajide Jagunna, Houston, TX (US); Kent S. Meyer, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/807,623

(22) Filed: Jul. 23, 2015

(51) Int. Cl.
*E21B 33/129* (2006.01)
*E21B 23/06* (2006.01)
*E21B 33/127* (2006.01)

(52) U.S. Cl.
CPC ..... *E21B 33/1293* (2013.01); *E21B 23/06* (2013.01); *E21B 33/127* (2013.01)

(58) Field of Classification Search
CPC .. E21B 33/1293; E21B 23/06; E21B 33/127; E21B 33/134; E21B 33/1208; E21B 33/1277; E21B 33/1292
USPC ..... 166/120, 127, 179, 118, 134, 140
See application file for complete search history.

(56) References Cited

U.S. PATENT DOCUMENTS 4,253,676 A * 3/1981 Baker ..... E21B 33/1277 166/122
4,403,660 A * 9/1983 Coone ..... E21B 33/128 166/179
5,613,555 A * 3/1997 Sorem ..... E21B 33/1277 166/187
6,009,951 A 1/2000 Coronado et al.
6,131,656 A * 10/2000 Jani ..... E21B 33/1293 166/192
6,779,601 B2 * 8/2004 Wilson ..... E21B 33/1208 166/118
8,336,634 B2 * 12/2012 Eatwell ..... E21B 33/128 166/118
8,905,149 B2 * 12/2014 Bailey ..... E21B 33/1208 166/207

* cited by examiner

*Primary Examiner* — James G Sayre
(74) *Attorney, Agent, or Firm* — Steve Rosenblatt

(57) ABSTRACT

A retrievable inflatable plug system features distinct seal and anchor elements where the seal element features overlapping ribs preferably metallic and preferably overlapping. The ribs extend the substantial length of the packer and are disposed under the annularly shaped sealing element. The anchor features exposed continuous ribs extending from opposed ends with one or more stiffener rings disposed on the exposed ribs. The elements can be inflated separately or together and include valving systems to allow deflation for selective removal of the plug to put a well back into service.

20 Claims, 2 Drawing Sheets

BOREHOLE ABANDONMENT METHOD USING RETRIEVABLE INFLATABLE BRIDGE PLUG WITH SEPARATE SEAL AND ANCHOR COMPONENTS

FIELD OF THE INVENTION

The field of the invention is inflatable plugs and more particularly those where the sealing and anchoring are accomplished by discrete inflatable elements which can be selectively deflated for plug removal.

BACKGROUND OF THE INVENTION

Wells occasionally need to be abandoned. Sometimes the abandonment is permanent and other times it is temporary. Abandonment usually requires an isolation device such as a bridge plug. In some abandonments the plug has cement delivered on to top it. In gas wells there are regulations for the level of sealing that is required. These standards are known as V0 or V3, for example.

While inflatables have been used in subterranean locations for a long time their use is principally focused on external casing packers mostly in open hole applications where the inflatables are extended with a material that sets up such as cement and the inflatable packer is intended to stay in position permanently. One concern in the design of inflatables is the available grip against differential pressure. Another concern is to avoid trapping fluids when inflating. This issue is often addressed with a sealing element that has overlapping metallic rib segments embedded in the opposed ends of the sealing element so that the unreinforced middle section of the sealing element comes out first to displace well fluids as the inflatable continues to enlarge under increasing inflate fluid pressure. In an effort to enhance the ability of the inflatable to grip, the sealing and anchoring functions have been assumed by discrete inflatables that seal and anchor respectively. One such design, U.S. Pat. No. 6,009,951, is shown in the context of a permanent packer inflated with cement with separate inflatables, as shown in that patent, 40 and 42 for sealing and anchoring respectively. The anchor portion 42, in that patent, has one or more stiffener rings 60. The sealing element 40 has embedded ribs at each end to encourage the middle of the sealing element to come out first so that well fluids can be displaced as the seal 40 is inflated into position. While this design works for a permanent external casing packer it does not achieve the sealing degree needed for gases per the available standards that are applied particularly to very deep wells in the order of 10,000 meters or deeper.

The present invention provides discrete anchor and sealing inflatables but disposes overlapping ribs under the annular sealing element in the seal portion of the assembly. The anchor portion includes one or more stiffeners and the inflatable elements have valving systems that permit deflation so that the well can be put into service after the bridge plug and any associated cement are removed. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A retrievable inflatable plug system features distinct seal and anchor elements where the seal element features overlapping ribs preferably metallic and preferably overlapping. The ribs extend the substantial length of the packer and are disposed under the annularly shaped sealing element. The anchor features exposed continuous ribs extending from opposed ends with one or more stiffener rings disposed on the exposed ribs. The elements can be inflated separately or together and include valving systems to allow deflation for selective removal of the plug to put a well back into service.

DETAILED DESCRIPTION OF THE PREFERRED EMBODIMENT

Figure 2:
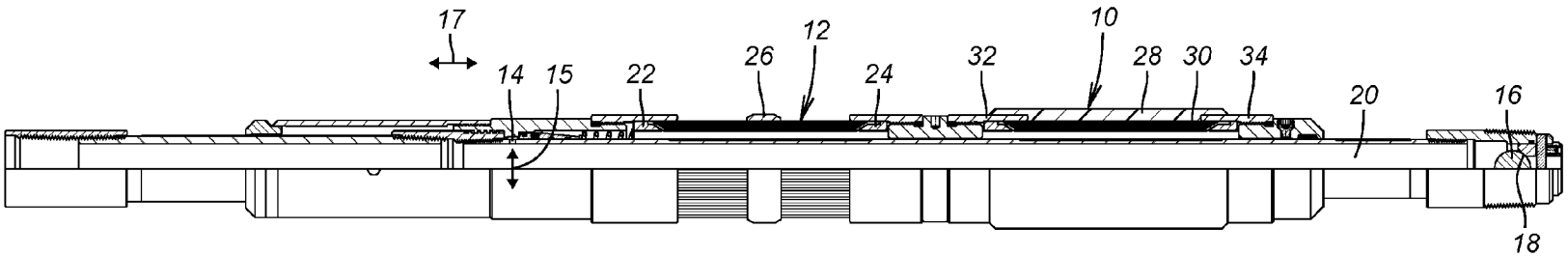
FIG. 2 is an alternative embodiment showing the anchor element on the uphole side.
Figure 3:
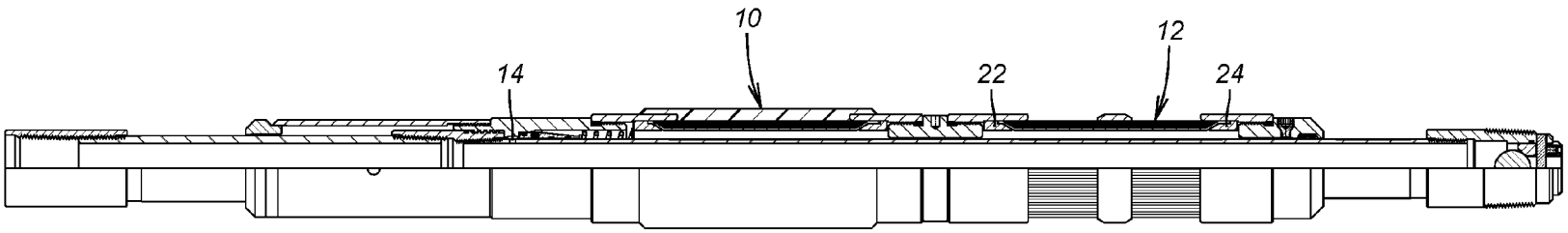
FIG. 3 is a zoomed out view of the assembly shown in FIG. 1.

Referring to FIGS. 2 and 3 the seal element assembly 10 is shown in the downhole position relative to the anchoring element assembly 12 and the order is reversed in FIG. 3. Assemblies 10 and 12 are mounted on mandrel 20. Both assemblies are inflated through ports 14 after ball 16 is landed on seat 18. Inflation can take place at the same or at staggered times for the assemblies 10 and 12. The anchor assembly 12 features a plurality of overlapping ribs 30 that extend continuously between ends 22 and 24 and further comprise flat metallic strips of a material compatible with well fluids. One or more stiffener rings 26 are used to stiffen the ribs 30 and control the amount of flexing. The rings 26 also press against the surrounding borehole tubular that is not shown to enhance the grip of the ribs 30 that are also in contact with the same surrounding borehole tubular.

Figure 1:
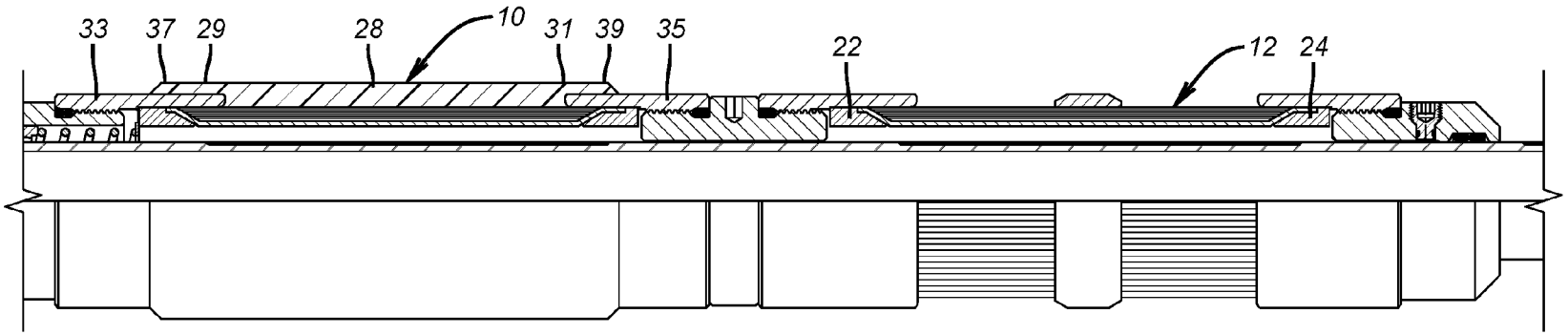
FIG. 1 is a part section view with the anchor element on the downhole side.

Referring to FIG. 1 it is seen that the sealing element 28 has opposed ends 29 and 31 that extend further and are bonded to end sleeves 33 and 35. The bond to each sleeve 33 and 35 is on an outer surface and an end surface as shown in FIG. 1. The sealing element 28 is also bonded to overlapping ribs 30 that extend the distance between sleeves 33 and 35. Because of this there is bonding to multiple surfaces for the sealing element 28 which tends to hold the extending portions 37 and 39 that respectively overlay sleeves 33 and 35 together to avoid popping off when inflated and subjected to differential pressure so that the standard V0 and V3 can be met with confidence.

The sealing element assembly 10 has an annularly shaped sealing element 28 that is preferably made of a single layer of material compatible with the anticipated well conditions. It can be a single layer of rubber or optionally multiple layers bonded together. As in the anchor assembly 12 there are overlapping ribs 30 that extend the full length of the sealing element 28 but are disposed preferably fully under the element 28. As an option the ribs 30 can be partially or fully embedded in the sealing element 28. As seen in FIG. 3 the arrangement of the assemblies 10 and 12 can be reversed from the FIG. 2 arrangement.

Optionally more than one sealing assembly 10 may be provided with the anchor assembly 12 positioned between seal assemblies 10 or at one end or the other. Multiples of assemblies 10 and 12 can be used in an alternating pattern or all of one kind of assembly together adjacent to the other type of assembly. As shown by double headed arrow 15, the valving system associated with inflate port 14 allows subsequent deflation so that both assemblies 10 and 12 can be removed if the well is to be put back in service. The abandoning occurs after inflation as shown in arrow 15 when expansion occurs. Removing happens after deflation as shown by arrow 15. Arrow 17 further illustrates the abandoning by movement to the right in conjunction with inflating and expanding the seal and anchor while movement to the left illustrates deflating and then removal by movement to the right. Collectively, the one or more seal assemblies 10 meet the V0 or V3 standard for fluid containment in the borehole. The details regarding the V0 and V3 standards are as follows: 3rd edition issued on April 2015 of ISO 14310: 2008 (Modified),

*Petroleum and Natural Gas*

*Industries—Downhole Equipment—Packers and Bridge Plugs*

V3 Acceptance Criteria—No more than 1% reduction in the maximum rated differential pressure over 15 minutes hold period, after sufficient time has been allowed for stabilization.

V0 Acceptance Criteria—Zero bubbles of gas accumulated in a graduated cylinder over the 15 minutes hold period after sufficient time has been allowed for stabilization.

The seal assemblies 10 can have one end such as 32 fixed while the opposite end 34 is movably mounted to facilitate movement of the sealing element 28 toward the surrounding tubular string in the borehole. The sealing element 28 may have an assembly inside diameter that is smaller than the outside diameter of the ribs 30 or the element could be formed onto the ribs 30.

The above description is illustrative of the preferred embodiment and many modifications may be made by those skilled in the art without departing from the invention whose scope is to be determined from the literal and equivalent scope of the claims below:

We claim:

1. A borehole abandonment method, comprising:

running in a removable plug assembly comprising at least one inflatable anchor component comprising first overlapping ribs and at least one surrounding stiffener ring and at least one spaced inflatable sealing component with said sealing component comprising second overlapping ribs extending along a covering sealing element, said sealing element is longer than said second overlapping ribs and where at least one of opposed ends of said sealing element extend over spaced end sleeves;

bonding said sealing element to said ribs and said end sleeves;

inflating said components to create a pressure barrier in the borehole;

abandoning the borehole due to said inflating.

2. The method of claim 1, comprising:

deflating said components;

removing said plug assembly from the borehole.

3. The method of claim 2, comprising:

deflating said components at the same time or at different times.

4. The method of claim 1, comprising:

placing said second overlapping ribs between a mandrel and said sealing element without embedding said second overlapping ribs in said sealing element.

5. The method of claim 1, comprising:

placing said second overlapping ribs between a mandrel and said sealing element with partial or total embedding said second overlapping ribs in said sealing element.

6. The method of claim 1, comprising:

building said sealing element on said second overlapping ribs.

7. The method of claim 6, comprising:

extending at least a portion of opposed ends of said sealing element over a respective adjacent said end sleeve.

8. The method of claim 7, comprising:

bonding said opposed ends of said sealing element to outer surfaces of said sleeves.

9. The method of claim 1, comprising:

building said sealing element as a standalone annular shape;

mounting said annular shape to said second overlapping ribs.

10. The method of claim 9, comprising:

providing a through bore to define said standalone annular shape;

sizing said through bore smaller than an outer dimension of said second overlapping ribs;

expanding said through bore to allow mounting said through bore over said ribs;

releasing said through bore to move against said second overlapping ribs when positioned over said second overlapping ribs.

11. The method of claim 1, comprising:

providing said first overlapping ribs extending a distance between opposed ends of said inflatable anchor.

12. The method of claim 11, comprising:

providing at least one stiffener ring overlapping said first overlapping ribs.

13. The method of claim 1, comprising:

engaging said sealing element with a surrounding tubular due to said inflating;

maintaining a gas seal with said sealing element meeting V0 or V3 standard.

14. The method of claim 1, comprising:

providing a plurality of sealing components as said at least one sealing component.

15. The method of claim 14, comprising:

mounting said anchor component between said sealing components or at one end of said sealing components.

16. The method of claim 15, comprising:

providing as said at least one anchor component a plurality of anchor components;

alternating said anchor and sealing components or grouping anchor components together alongside said sealing components that are also grouped together.

17. The method of claim 1, comprising:

inflating said components at the same time or at different times.

18. The method of claim 1, comprising:

bonding spaced end portions of said sealing element over said spaced end sleeves.

19. The method of claim 18, comprising:

bonding opposed ends of said sealing element to outer and end surfaces of said spaced end sleeves.

20. The method of claim 1, comprising:

said second overlapping ribs extend for the substantial length of said sealing element between said end sleeves.

* * * * *